US011254470B2

(12) United States Patent
McNamara et al.

(10) Patent No.: US 11,254,470 B2
(45) Date of Patent: Feb. 22, 2022

(54) CONTAINER COVERING DEVICE

(71) Applicants: Kevin Patrick McNamara, Ramsey, MN (US); James Edward Hangge, Buffalo, NY (US)

(72) Inventors: Kevin Patrick McNamara, Ramsey, MN (US); James Edward Hangge, Buffalo, NY (US)

(73) Assignee: Kevin Patrick McNamara, Ramsey, MN (US)

( * ) Notice: Subject to any disclaimer, the term of this patent is extended or adjusted under 35 U.S.C. 154(b) by 98 days.

(21) Appl. No.: 16/720,718

(22) Filed: Dec. 19, 2019

(65) Prior Publication Data

US 2020/0198840 A1 Jun. 25, 2020

Related U.S. Application Data

(60) Provisional application No. 62/782,251, filed on Dec. 19, 2018.

(51) Int. Cl.
*B65D 25/20* (2006.01)
*B65F 1/14* (2006.01)

(52) U.S. Cl.
CPC ..... *B65D 25/20* (2013.01); *B65F 1/1426* (2013.01); *B65D 2203/00* (2013.01); *B65F 2210/13* (2013.01)

(58) Field of Classification Search
CPC .... B65D 25/20; B65F 1/1426; B65F 2210/13; A47G 29/06
See application file for complete search history.

(56) References Cited

U.S. PATENT DOCUMENTS 716,668 A 12/1902 Cheney
1,868,853 A 7/1932 Sievers
(Continued)

FOREIGN PATENT DOCUMENTS

DE 202005018298 U1 3/2006
DE 102008033050 A1 1/2010
(Continued)

OTHER PUBLICATIONS

Snap Drape 5412WC44F014 Wyndham 44 Gallon Black Shirred Pleat Trash Can Cover, Retrieved online from <https://www.webstaurantstore.com/snap-drape-5412wc44f014-wyndham-44-gallon-black-shirred-pleat-trash-can-cover/757TCCSJ44BK.html> on Feb. 10, 2020, and believed to be publicly available more than one year prior to the filing date of the instant application, 8 pages.

*Primary Examiner* — Andrew T Kirsch
(74) *Attorney, Agent, or Firm* — Fredrikson & Byron, P.A.

(57) ABSTRACT

Devices, systems, and methods for covering containers are disclosed herein. Embodiments thereof include a cover member, a support assembly, and a retainer assembly. The cover member having each of top and bottom edges and first and second lateral sides, together defining a cover member body having upper, middle, and lower portions. The cover member is configured both to be supported by a container and to adjustably wrap around at least a portion of the container to conceal the portion from a point of view. The support assembly is configured both to removably attach the cover member to the container and to adjust a vertical position of the cover member relative to the container, thereby positioning the cover member at the container, allowing adjustment of the cover member's tautness around the container. The retainer assembly is configured to secure
(Continued)

and to adjust and maintain the cover member's tautness around the container.

20 Claims, 12 Drawing Sheets

(56) References Cited

U.S. PATENT DOCUMENTS

| | | | | |
|---|---|---|---|---|
| 2,142,301 | A | | 1/1939 | Buchalter |
| 3,450,302 | A | * | 6/1969 | Braught ..... B65F 1/1468 220/780 |
| 4,735,340 | A | | 4/1988 | Preston |
| 5,305,907 | A | | 4/1994 | Richardson et al. |
| 5,318,821 | A | | 6/1994 | Bradley, Jr. |
| 5,524,384 | A | | 6/1996 | Weder et al. |
| 5,553,733 | A | | 9/1996 | Rosenthal |
| 5,671,861 | A | | 9/1997 | Hall et al. |
| 6,341,713 | B1 | | 1/2002 | Kilmer |
| 7,121,027 | B1 | | 10/2006 | Sadallah |
| 9,522,779 | B2 | * | 12/2016 | Brooks ..... B65F 1/1646 |
| 2004/0232157 | A1 | | 11/2004 | Smith |
| 2005/0076980 | A1 | | 4/2005 | Hamdan |
| 2008/0163965 | A1 | | 7/2008 | McNelly |
| 2012/0055597 | A1 | | 3/2012 | Aznar-Meyer et al. |
| 2013/0126058 | A1 | | 5/2013 | Miller, Jr. |
| 2015/0314918 | A1 | | 11/2015 | Lausch |
| 2016/0107836 | A1 | | 4/2016 | Kirby |
| 2017/0001798 | A1 | | 1/2017 | Thornton |

FOREIGN PATENT DOCUMENTS

| | | | |
|---|---|---|---|
| EP | 1997749 | A1 | 12/2008 |
| GB | 2454502 | A | 5/2009 |
| GB | 2480502 | A | 11/2011 |
| WO | 2013151444 | A2 | 10/2013 |

* cited by examiner

CONTAINER COVERING DEVICE

CROSS-REFERENCE TO RELATED APPLICATION

This application claims the benefit of U.S. Provisional Patent Application No. 62/782,251, filed Dec. 19, 2018, which is incorporated by reference herein in its entirety.

TECHNICAL FIELD

This disclosure relates generally to the field of containers, such as storage or transport refuse containers, and, more particularly, to devices, systems, and methods for covering or wrapping refuse containers.

BACKGROUND

Containers can be used in a variety of contexts to store material. Examples of such containers include refuse containers. Although they come in a variety of shapes and sizes, traditional refuse containers are designed more for functionality than to be aesthetically pleasing. And often these refuse containers are left outdoors because they are unsightly, tend to seep smells, require too much interior storage space, or are difficult or inconvenient to move to a designated pickup area. Thus, refuse containers left outdoors, especially in residential areas, create eyesores. These circumstances lead to low curb appeal of a residence and sometimes extra structure or effort to conceal the refuse containers until it is time for them to be emptied.

Despite the availability of a number of conventional refuse container covers, none address all of the challenges presented by traditional refuse containers. It is desirable for an aesthetic refuse container cover to be easily assembled and removed for purposes of storage and emptying the container, to be durable for sustained exposure outdoors, to be adjustable for fitting different sized containers, and to be able to display signage or other artwork. Existing covers involve complex construction, assembly, or both, thereby decreasing the likelihood of use by making normal operation clunky and frustrating. Although some existing covers are robustly designed, most of them have a fragile construction not meant for sustained use outdoors or are overdesigned so as to be unreasonably priced.

SUMMARY

Exemplary embodiments are described herein for covering and protecting refuse containers in a uniform, form fitting manner and in an adjustable and easy-to-assemble design. Various embodiments described herein can provide a container covering device comprising a cover, a support assembly, and a retainer assembly. The container covering device may fit onto and surround at least a portion of the refuse container from a base surface upon which the refuse container rests to a top edge of a rim of the refuse container. Once assembled, the container covering device can allow the refuse container to function normally while providing an aesthetically pleasing exterior.

A container covering device with such features can provide a variety of advantages. For example, the refuse container can be disguised and protected from rummaging animals or act to camouflage the refuse container, e.g., with a landscape or an exterior of a building. The container covering device can be adjustable to cover refuse containers of different sizes with a uniform look and taut fit while allowing the refuse containers to function normally. The container covering device can be easy to construct, assemble, disassemble, and store while also being durable enough to withstand sustained exposure, e.g., outdoors.

An embodiment of the container covering device can include a cover member, a support assembly, and a retainer assembly. The cover member can have a top edge, a bottom edge, a first lateral side, and a second lateral side. Each of the top edge, the bottom edge, the first lateral side, and the second lateral side can define a cover member body. The cover member body can have an upper portion, a middle portion, and a lower portion. The cover member can be configured both to be supported by a container and to adjustably wrap around at least a portion of the container such that the portion of the container is concealed (e.g., top to bottom) from a point of view. The support assembly can be configured both to removably attach the cover member to the container and to adjust a vertical position of the cover member relative to the container. The cover member can thereby be positioned at the container to allow a tautness of the cover member around the container to be adjusted. The retainer assembly can be configured to secure the cover member to the container and to adjust and maintain the tautness of the cover member around the container.

Examples of this embodiment may have different features of the container covering device or its components. In an example, the support assembly removably attaches the cover member to the container such that the cover member is supported by the container at a support height and such that the cover member is draped along the outside of the container. This example can have at least one of the following features: the top edge of the cover member extends upward above the support height to cover components of the container above the support height and the cover member is draped such that the bottom edge of the cover member is suspended to extend along a majority of the support height. In an example, the support assembly includes a first fastener directly attached to the container and configured to removably attach to a support site positioned at the cover member. In another example, the support assembly includes a support site being positioned at the cover member and extending along a height of the cover member and a bracket having a container connecting portion configured to attach to the container and a support site connecting portion configured to removably attach to the support site. The support site connecting portion in this example can be positionable about the support site. In another example, the cover member body includes at least one rib extending along a width of the cover member. Each rib of the at least one rib can be configured to reinforce a shape of the cover member.

In another embodiment, a container covering system can include a container and a container covering device. The container can have a container bottom and a container outer wall upwardly extending from the container bottom. The container outer wall can define a container interior volume and a container rim surrounding an opening to the container interior volume. The container covering device can include a cover member, a support assembly, and a retainer assembly. The cover member can have a top edge, a bottom edge, a first lateral side, and a second lateral side. Each of the top edge, the bottom edge, the first lateral side, and the second lateral side can define a cover member body. The cover member body can have an upper portion, a middle portion, and a lower portion. The cover member can be configured both to be supported by a container and to adjustably wrap around at least a portion of the container such that the portion of the container is concealed from a point of view.

The support assembly can be configured both to removably attach the cover member to the container and to adjust a vertical position of the cover member relative to the container. The cover member can thereby be positioned at the container to allow a tautness of the cover member around the container to be adjusted. The retainer assembly can be configured to secure the cover member to the container, to adjust the tautness of the cover member around the container, and/or to maintain the tautness of the cover member around the container.

In other embodiments, a method for covering a container is disclosed. The method may include a step of providing a container covering device, which can be similar to those described in reference to other embodiments herein. The method can include selecting a container, which can be similar to those described in reference to other embodiments herein. The method can include steps of assembling the container covering device, adjusting the container covering device for the container, and securing the container covering device to the container. Some examples of the method further include a step of removing the container covering device.

The details of one or more examples are set forth in the accompanying drawings and the description below. Other features, objects, and advantages will be apparent from the description and drawings.

BRIEF DESCRIPTION OF DRAWINGS

The following drawings are illustrative of particular embodiments of the present invention and therefore do not limit the scope of the invention. The drawings are intended for use in conjunction with the explanations in the following description. Embodiments of the invention will hereinafter be described in conjunction with the appended drawings, wherein like numerals denote like elements.

DETAILED DESCRIPTION

The following detailed description is exemplary in nature and provides some practical illustrations and examples. Those skilled in the art will recognize that many of the noted examples have a variety of suitable alternatives. A number of various exemplary container covering devices, assemblies, and methods are disclosed herein using the description provided as follows in addition to the accompanying drawings. Each of the embodiments disclosed herein can be employed independently or in combination with one or more (e.g., all) of the other embodiments disclosed herein.

Figure 1:
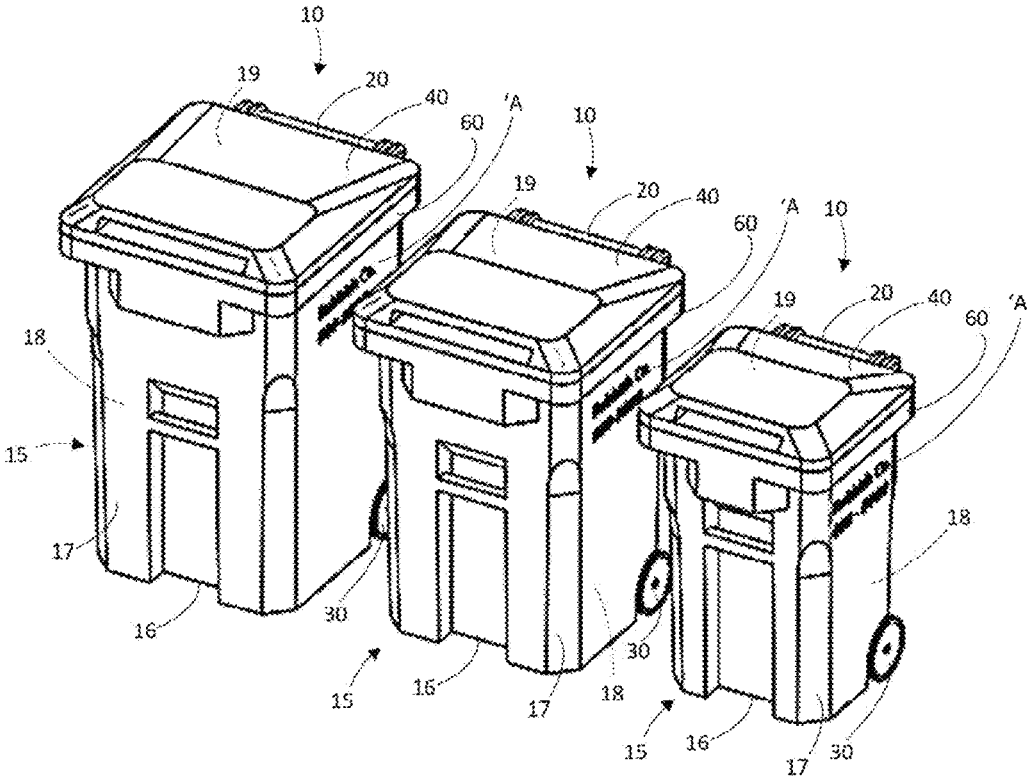
FIG. 1 is a perspective view of three containers varying in size.

Coming in a variety of shapes and sizes, a traditional refuse container 10 as seen in FIG. 1 is adapted to have a specific capacity and function associated with a desired or anticipated use of the container 10. Standard capacities for such a container 10 include about 35 gallons, about 65 gallons, and about 95 gallons. In general, a conventional refuse container 10 includes a container body 15, a handle 20, a wheel assembly 30, and a lid 40 as well as markings, 'A, which can identify an associated service provider. The handle 20 may be positioned at an upper back portion of the container body 15, and the wheel assembly 30 may be positioned at a lower back portion of the container body 15 (e.g., near a container bottom 16) such that the container 10 is readily wheeled by pulling the handle 20 over wheels in the wheel assembly 30 and tilting the container 10. The container body 15 can have a container outer wall 17 upwardly extending from the container bottom 16. The container outer wall 17 can define a container interior volume 18, which can hold materials, with an opening 19 opposite the container bottom 16. The lid 40 may hingedly connect to the container body 15 at the handle 20 to cover and uncover the opening 19 in the container 10 by moving between a covered and uncovered position respectively. When in the covered position, the lid 40 may be supported by a rim 60 surrounding the opening 19 to form a substantially tight fit with the container body 15.

Figure 2:
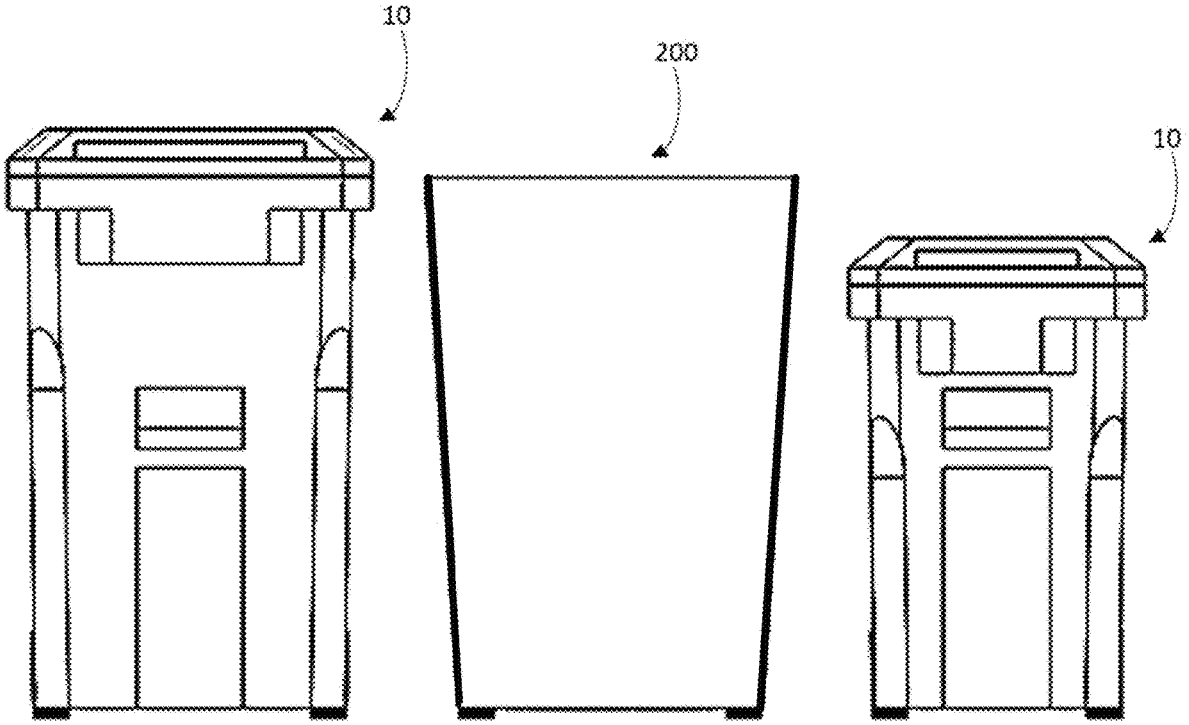
FIG. 2 is a side elevational view of the three containers in FIG. 1 with the middle container including an embodiment of a container covering device secured to it while the other two containers do not include the container covering device.

FIG. 2 is a side elevational view of three containers in FIG. 1. In FIG. 2, one of the containers includes an embodiment of a container covering device 200 secured to the container 10 while the other two containers do not include the container covering device 200. As shown in FIG. 2, the container covering device 200 can conceal the container 10. As discussed here throughout, to conceal the container 10 may mean to camouflage, to surround, to cover, to disguise, to hide, to mask, to veil, or to otherwise cover the container 10 in its entirety or portions thereof.

An illustrative container covering device 200 as shown in FIG. 2 can cover a container 10 so as to conceal the container 10 from certain points of view. The container covering device 200 may attach to the container 10 to cover and protect the container 10. When attached to the container 10, the container covering device 200 can be configured to be supported by the container 10 and/or to adjustably wrap around at least a portion of the container 10 such that the portion of the container 10 is concealed from a point of view. To assemble the container covering device 200 onto the container 10, the container covering device 200 can be adjusted to the size of the container 10, attached to be supported by the container 10, wrapped around the container 10, and secured to the container 10. Once assembled, the container covering device 200 can surround at least a portion of and be supported by the container 10, e.g., such that the container 10 can be camouflaged by the container covering device 200 at least from a frontal view. In many instances, the container 10 may be camouflaged from a low point of view, wrapped surround a majority of a periphery of the container 10, or surround an entirety of a periphery of the container 10.

Figure 3A:
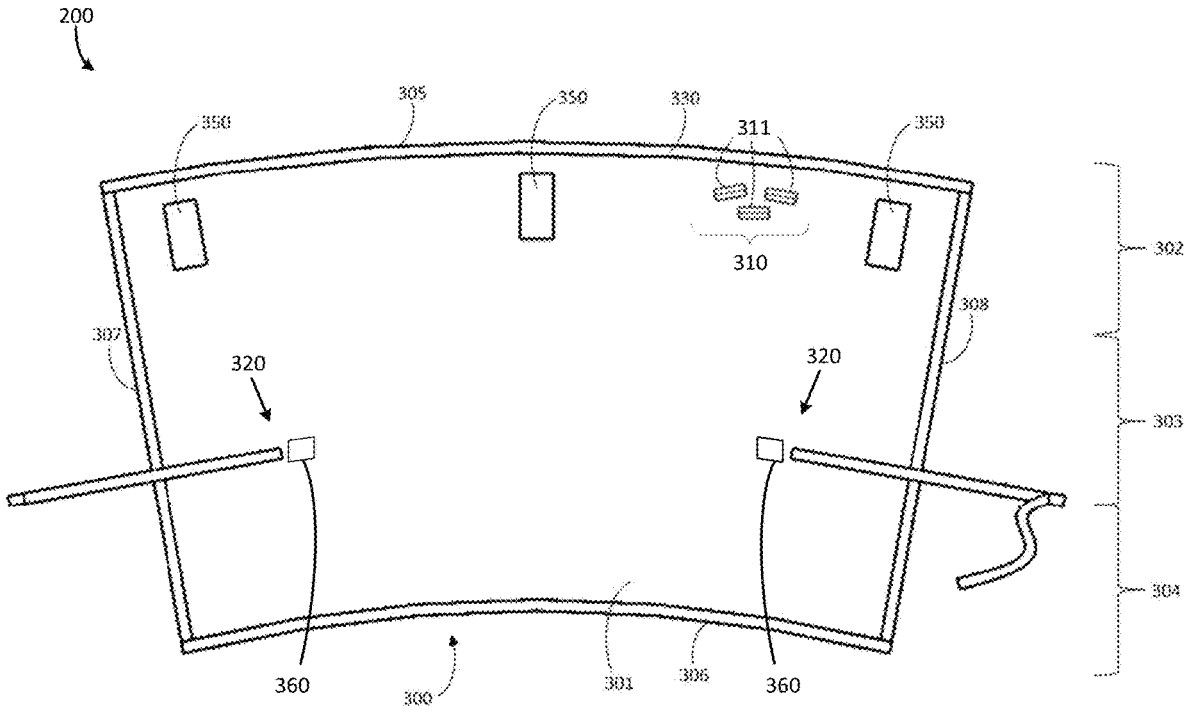
FIG. 3A-3C are a plan views of the container covering device in FIG. 2 with FIG. 3A showing both a retainer assembly and a support assembly being unsecured to a cover member in the container covering device, FIG. 3B showing dimensions of a cover member body of the cover member, and FIG. 3C showing the retainer assembly and the support assembly secured to the cover member along with dimensions of retaining sites, support sites, and ribs.
Figure 3B:
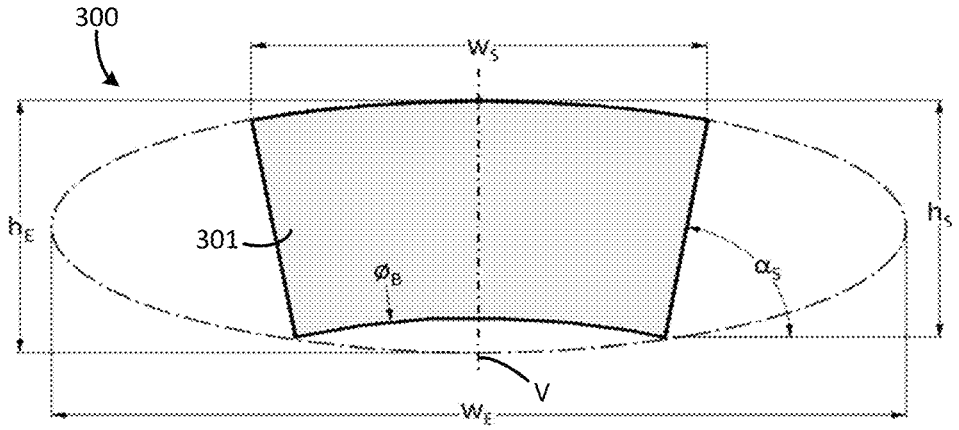
Figure 3C:
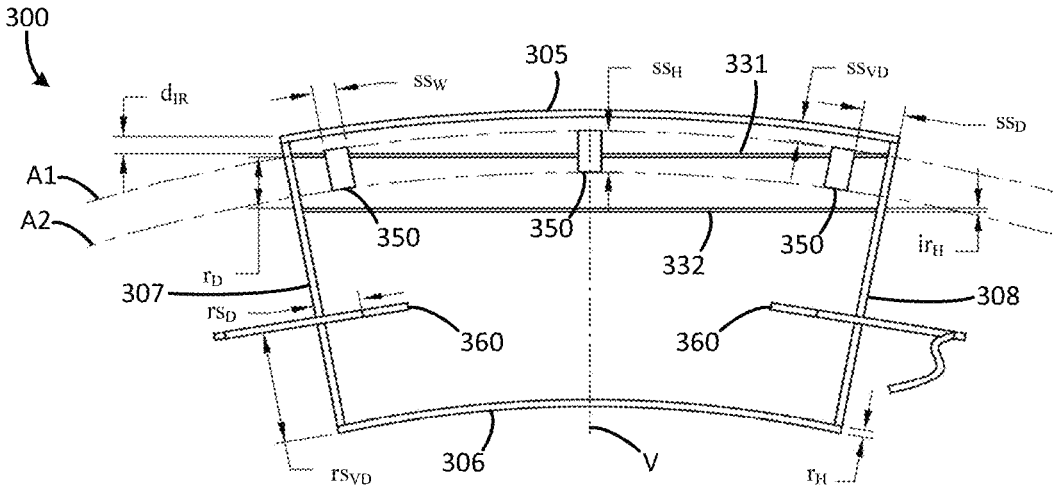

FIGS. 3A-3C are plan views of the container covering device 200 in FIG. 2. In FIG. 3A, both the retainer assembly 320 and the support assembly 310 are unsecured to the cover member 300 in the container covering device 200. FIG. 3B shows dimensions of the cover member body 301. And FIG. 3C shows the retainer assembly 320 and the support assembly 310 secured to the cover member 300 along with dimensions of a retaining site 360, a support site 350, and a rib 330.

As can be seen in FIG. 3A, the container covering device 200 can include components configured to facilitate quick assembly and disassembly while supplying a uniform, taut fit once installed on a container. Components of the container covering device 200 may include a cover member 300, a support assembly 310, and a retainer assembly 320. The cover member 300 may include a cover member body 301 having an upper portion 302, a middle portion 303, and a lower portion 304. Many embodiments of the cover member 300 include a top edge 305, a bottom edge 306, and first and second lateral sides 307, 308. The support assembly 310 can be removably attached to the cover member 300, e.g., at a support site 350 in the upper portion 302 of the cover member 300 as will be described in further detail hereinafter. The retainer assembly 320 can be attached to the cover member 300, e.g., at a retaining site 360 in either the middle portion 303 or the lower portion 304 of the cover member 300 and/or adjacent to at least one of the first lateral side 307 and the second lateral side 308. The retainer assembly 320 can be configured to secure the cover member 300 to the container, to adjust the tautness of the cover member 300 around the container, and/or to maintain the tautness of the cover member 300 around the container.

The shape of the cover member 300 may facilitate covering a container with a taut fit. For instance, the cover member 300 can be symmetric about a midplane of the cover member 300. The bottom edge 306 of the cover member 300, the top edge 305 of the cover member 300, or both may be curved. In some embodiments, the radius of curvature for each of the top edge 305 (e.g., a first radius of curvature) and the bottom edge 306 (e.g., a second radius of curvature) may be the same and in the same direction (e.g., concentric and/or parallel). In some embodiments, the first radius of curvature is different from the second radius of curvature. The first and second lateral sides 307, 308 may be tapered, e.g., from the top edge 305 to the bottom edge 306 of the cover member 300. For example, each of the first lateral side 307 and the second lateral side 308 can be downwardly tapered from the top edge 305 to the bottom edge 306. In some embodiments, the cover member body 301 may comprise a single piece (e.g., integrally manufactured) and, in other embodiments, may comprise multiple pieces joined together (e.g., similar or distinct portions joined together). The cover member 300 may include one or more cutouts (not shown), e.g., at the intersection of the top edge 305 and the first and second lateral sides 307, 308, to fit certain containers. Some such cutouts, for example, can allow the cover member 300 to fit under the handle of the container or around wheels in the wheel assembly. As can be appreciated, any of the shape features of the cover member 300 (e.g., cutouts, curved edges, tapered edges, etc.) may be included at different parts of the cover member 300 (e.g., interior cutouts at the cover member 300, cutouts for the wheel assembly or handle, etc.).

FIG. 3B shows an example of dimensioning for the shape of the cover member 300. Here in the illustration, the cover member body 301 can include the following dimensions: a cover member body height, $h_s$, a cover member body width, $w_s$, a cover member body ellipse height, $h_E$, a cover member body ellipse width, $w_E$, a cover member body bottom diameter, $ø_B$, and a cover member body side angle, $\alpha_S$s. In this example, the cover member 300 is symmetrical about a vertical line, V, and the aforementioned dimensions can vary with respect to the size of the container as provided in the approximate dimensions below in Table 1.

TABLE 1

| | | $h_S$ (in) | $w_S$ (in) | $h_E$ (in) | $w_E$ (in) | $ø_B$ (in) | $\alpha_S$ (deg) |
|---|---|---|---|---|---|---|---|
| Size of Container | Large | 47 | 80 | 50 | 150 | 275 | 80 |
| | Medium | 43 | 70 | 43.75 | 131.25 | 275 | 80 |
| | Small | 39 | 60 | 37.5 | 112.5 | 275 | 80 |
| Tolerances (+/−) | | 7 | 12 | 7.5 | 22.5 | 40 | 12 |

Referring again to FIG. 3A, the cover member 300 may be configured to adjustably wrap around and surround at least a portion of the container regardless of its capacity while also compactly folding or rolling into a bundle or tube for storage. One or more support sites 350 and/or retaining sites 360 may be provided at the cover member 300 to facilitate attaching the support assembly 310 and the retainer assembly 320 to the cover member 300 respectively. Both the support site 350 and retaining site 360 may include different attachment points or markings to indicate placement of the support assembly 310 and retainer assembly 320 respectively for different sized containers. Accordingly, the support assembly 310 and the retainer assembly 320 may be adjusted to fit different-sized containers. The cover member 300 may be made of a flexible material such as polyvinyl chloride (e.g., PVC or vinyl), recyclable PET vinyl, knitted polyester, poplin, tabbinet, or a polyethylene substrate (e.g., scrim vinyl or other similar material suitable for being printed on), which may aid in adjusting the cover member 300. In many instances, the cover member 300 is flexible so as to be foldable or rollable for compact storage when the container covering device 200 is not assembled or in use.

The rib 330 may be included in the upper portion 302, e.g., to maintain a uniform look of the container covering device 200 when installed. In many instances, the rib 330 may be more rigid than other portions of the cover member 300. When installed, the rib 330 may extend above the lid of the container. The rib 330 can extend along a width of the cover member 300. The rigidity of the rib 330 can act to reinforce a uniform shape such that the less rigid portion of the cover member 300 uniformly extend along the outer surface of the container, e.g., as the cover member 300 extends upward above the lid of the container.

Construction and position of the rib 330 may vary in different embodiments. However, in various embodiments, the rib 330 remains more rigid than other portions of the cover member 300. For instance, the rib 330 may comprise layered or folded material that may be the same or different material as other portions of the cover member 300. However, in some instances, the rib 330 may have the same rigidity as other portions of the cover member 300. The rib 330 may comprise one or more inserts. In some instances, the rib 330 may be provided elsewhere on the cover member 300 or, e.g., more than one rib 330 may be provided throughout the cover member 300.

FIG. 3C shows an example of dimensioning for retaining sites 360, support sites 350, and ribs 330. In this example, the cover member 300 is symmetrical about a vertical line, V. Here in the illustration, the retaining site 360 can be positioned at a retaining site depth, $rs_D$, and a retaining site vertical dimension, $rs_{VD}$, at the cover member 300. The retaining site vertical dimension can be between about 4 and 28 inches (e.g., about 16 inches) from the bottom edge 306, and the retaining site depth can be between about 0 and 12 inches from the first lateral side 307. The support site 350 can be positioned at a support site depth, $ss_D$, and a support site vertical dimension, $ss_{VD}$, at the cover member 300. The support site depth can be between 0 and 10 inches (e.g., about 5 inches) from the second lateral side 308, and the support site vertical dimension can be between about 0 and 6 inches (e.g., about 3 inches) from the top edge 305. The support site 350 can have a support site width, $ss_W$, that is between about 0 and 6 inches (e.g., about 3 inches) and a support site height, $ss_H$, that is between about 3 and 9 inches (e.g., about 6 inches). As shown, each support site 350 can have an identical width and can be spaced about the cover member 300 along first and second arc lines, A1 and A2 respectively. As also shown here, there can be first and second intermediate ribs 331, 332. Each of the first and second intermediate ribs 331, 332 can have a rib height, $ir_H$, of between about 0 and 1 inches (e.g., about 0.5 inches), and the first intermediate rib 331 can be spaced by a distance, $d_{IR}$, of about between 0 and 10 inches (e.g., about 2.5 inches) from a corner where the first lateral side 307 meets the top edge 305. The first and second intermediate ribs 331, 332 can be separated by a rib distance, $r_D$, of between about 0 and 10 inches (e.g., about 7.5 inches). The bottom edge 306 can include a rib 330 having a rib height, $r_H$, of about between 0 and 2 inches (e.g., about 1 inch).

Figure 4A:
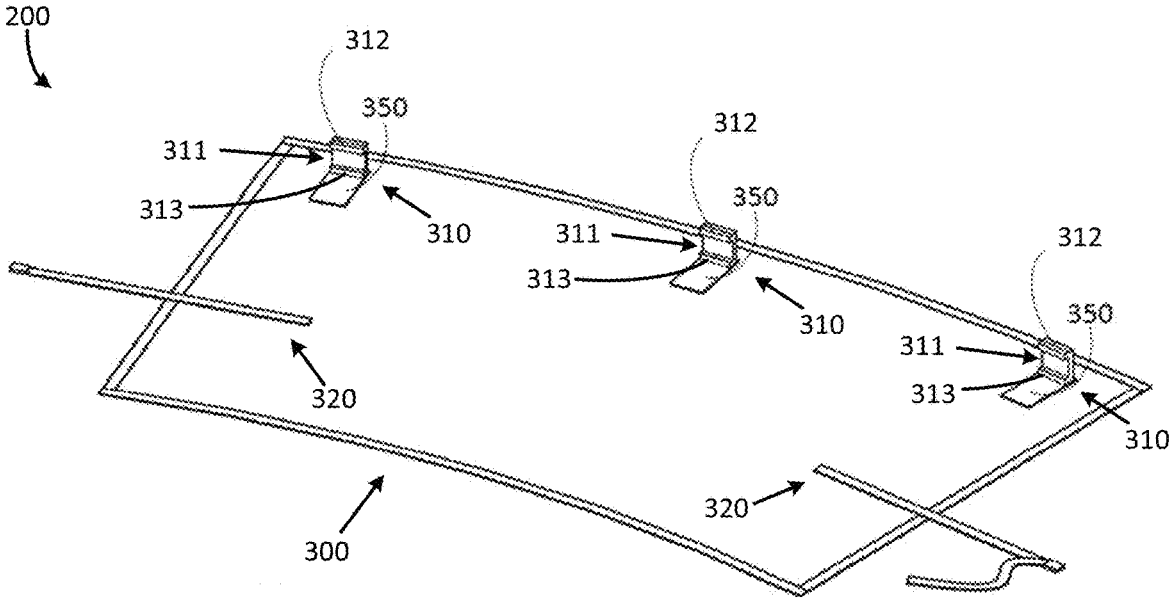
FIGS. 4A and 4B are perspective views of the container covering device of FIG. 2 having the support assembly attached to support sites at different positions, with FIG. 4A showing the support assembly attached to the support site at an upper position and FIG. 4B showing the support assembly attached to the support site at a lower position.
Figure 4B:
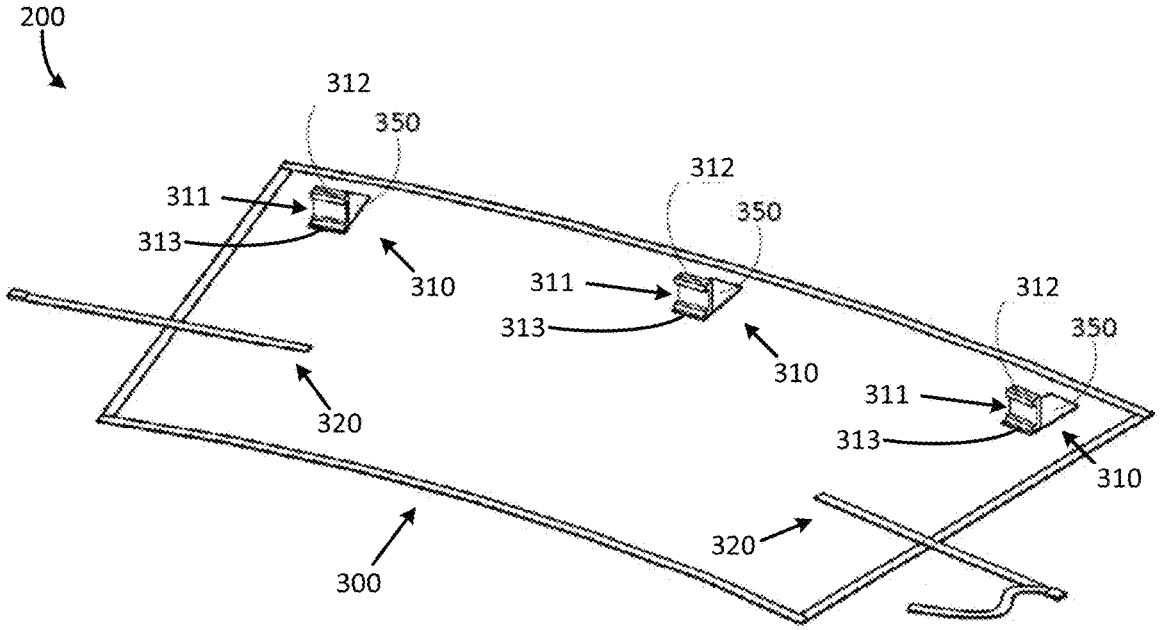

FIGS. 4A and 4B show the support assembly 310 attached to support sites 350 at different positions. FIG. 4A is a perspective view of the container covering device 200 in FIG. 2. In FIG. 4A, the retainer assembly 320 and support assembly 310 are secured to the cover member 300, and the support assembly 310 is attached to the support site 350 at an upper position. FIG. 4B is a perspective view of the container covering device 200 with the support assembly 310 attached to the support site 350 at a lower position.

The support assembly 310 may be adjustable between the positions shown in FIGS. 4A and 4B. For instance, containers with larger capacity may have the support assembly 310 installed at an upper position of the support site 350 as shown in FIG. 4A. On the other hand, for containers with smaller capacity, the support assembly 310 may be installed at a lower position on the support site 350 as shown in FIG. 4B. Sometimes, the support assembly 310 may be installed at a position between the upper position and the lower position. In any of these instances, the support assembly 310 may be adjusted to attach the cover member 300 to the container.

The cover member 300 may attach to the container via the support assembly 310, which can be a rigid structure that is attachable to the container. The support assembly 310 as shown in FIG. 4A may include any number of different supports or combinations thereof. For instance, the support assembly 310 may comprise one or more brackets 311 (e.g., clips, C brackets, U brackets, L brackets, etc.) or braces (e.g., corner, right angle, etc.) configured to attach to a portion of the container such as the rim or along the outer surface. Each bracket can have a container connecting portion 312 configured to attach to the container and a support site connecting portion 313 configured to removably attach to the support site 350 at the cover member 300. The support site connecting portion 313 can be positionable about the support site 350. The support assembly 310 in some instances may further include a securing device (not shown), such as a clamp, a thumb screw, double-sided tape, etc., to further secure the bracket to the container. In some instances, the support assembly 310 may be an integral feature to the cover member 300 such as a lip inwardly extending from the cover member 300 toward the container when the container covering device 200 is installed on the container. Such embodiments of the cover member 300 may be configured to fit at the rim of the container and attach to the rim of the container via one or more fasteners along the rim or at the interior of the container. The support assembly 310 can comprise a rigid material such as plastic or metal. The support site 350, as mentioned prior herein, can take a variety of forms, including an integral feature in the cover member 300, a fastener, or portions of a fastener.

Figure 5A:
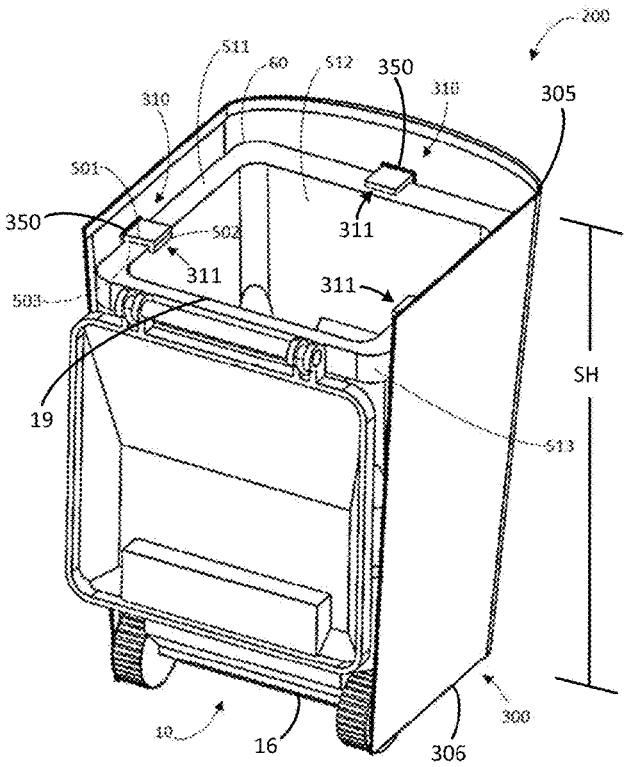
FIGS. 5A-5C are perspective views of the container covering device and show various examples of the support assembly with FIG. 5A showing the support assembly as brackets attached to the support site at an upper position of the support site, FIG. 5B showing the support assembly as brackets attached to the support site at a lower position of the support site, and FIG. 5C showing the support assembly as a first fastener attached to the support site at a lower position of the support site.
Figure 5B:
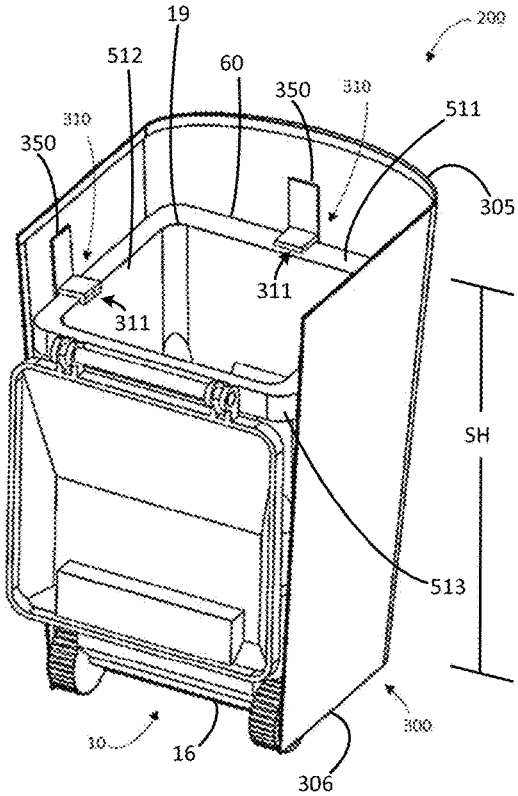
Figure 5C:
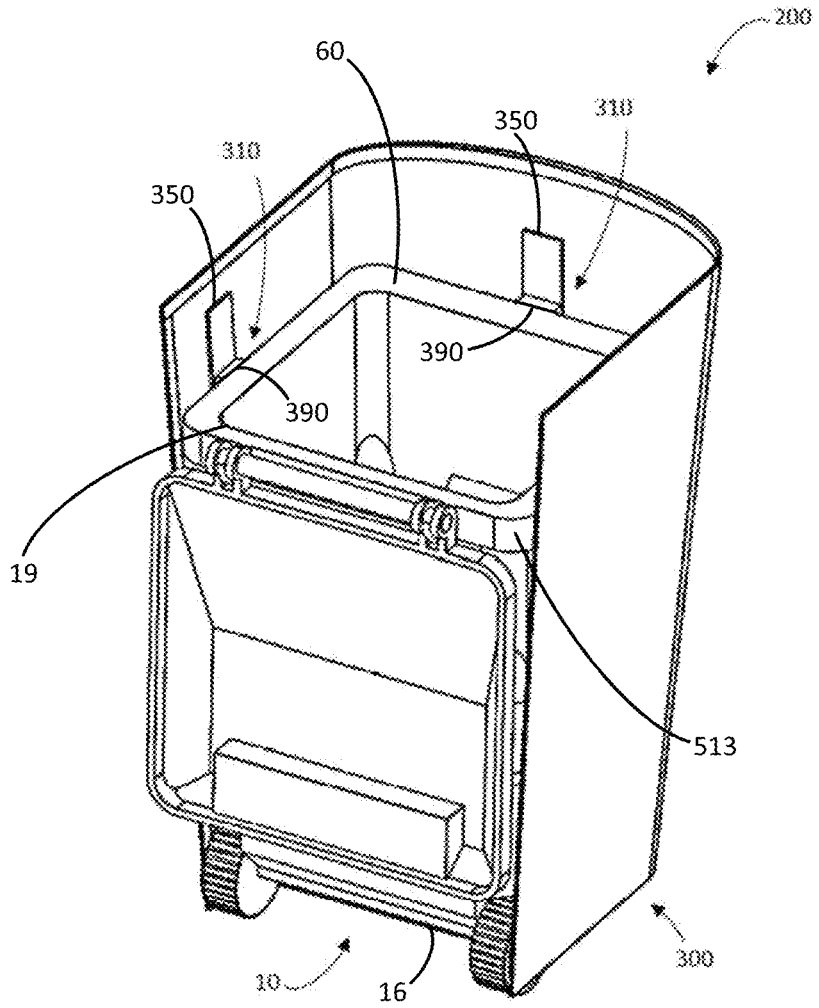

FIGS. 5A-5C show features and examples of the support assembly 310 and the support site 350. FIGS. 5A and 5B show an example where the support assembly 310 includes brackets 311 and each support site 350 includes a removable fastener attachable to the brackets 311. FIG. 5A is a perspective view of the container covering device 200 of FIG. 2 secured to a large container 10. In FIG. 5A, the support assembly 310 includes a bracket attached to the support site 350 at an upper position (similar to that shown in FIG. 4A) and positioned on an upper surface 511 of a rim 60 around an opening 19 of the large container 10. And FIG. 5B is a perspective view of the container covering device 200 of FIG. 2 secured to a small container 10. In FIG. 5B, the support assembly 310 includes the bracket attached to the support site 350 at a lower position (similar to that shown in FIG. 4B) and positioned on an upper surface 511 of a rim 60 around an opening 19 of the small container 10. FIG. 5C shows an example where the support assembly 310 includes a first fastener 390 attached to the container 10 and each support site 350 includes a removable fastener that is attachable to the first fastener 390. FIG. 5C is a perspective view of the container covering device 200 of FIG. 2 secured to a small container 10 with another embodiment of the support assembly 310. In FIG. 5C, the support assembly 310 includes a first fastener 390 attached to the support site 350 at a lower position and directly attached to an outer surface 513 of a rim 60 around an opening 19 of the small container 10.

As shown in FIGS. 5A-5C, the support assembly 310 is attached to the cover member 300 and the container 10. The support assembly 310 can be removably attached to the cover member 300 at the support site 350. The support site 350 can be positioned at the cover member 300 and can extend along a height of the cover member 300. For instance, the support assembly 310 may attach to the cover member 300 using removable fasteners (e.g., hook-and-loop fasteners, snap fasteners, etc.), an integral attachment feature of the cover member 300 (e.g., a snap-fit feature, a slot, a pocket, etc.), or any combination thereof. In some such instances, the support assembly 310 is a removable fastener. With this arrangement, for example, the support assembly 310 can be directly and rigidly attached to the container 10 (e.g., thereby forming the first fastener 390) and can be configured to removably attach to the support site 350 positioned at the cover member 300. In such examples, the first fastener 390 may be attached to any of the upper surface 511, the inner surface 512, or the outer surface 513 of the rim 60 so long as it can attach to the cover member 300.

The support assembly 310 may be configured to removably attach the cover member 300 to the container 10 and/or to adjust a vertical position of the cover member 300 relative to the container 10. The cover member 300 can thereby be positioned at the container 10 to allow a tautness of the cover member 300 around the container 10 to be adjusted. Each of the vertical position and the tautness of the cover member 300 can be adjusted such that the cover member 300 is positioned to allow a clearance space between portions of the cover member 300 (e.g., upper, middle, and lower portion of the cover member 300) and the container 10. In this way, moving components of the container 10 can be allowed enough clearance to not interrupt their normal operation and so as not to damage the cover member 300. In operation, the support assembly 310 can removably attach the cover member 300 to the container 10 such that the cover member 300 is supported by the container 10 at a support height, SH, extending between the container bottom 16 and the rim 60 and/or such that the cover member 300 is draped along the outside of the container 10. (Thus, the support height, SH, for a smaller, shorter container 10 can be less than the support height, SH, for a larger, taller container 10.) In this manner, in some embodiments, at least one of the top edge 305 of the cover member 300 can extend upward beyond the support height, SH, to cover components of the container 10 above the support height, SH, and the cover member 300 can be draped such that the bottom edge 306 of the cover member 300 is suspended to extend along a majority of the support height, SH. Versatility of the support assembly 310 may extend beyond attaching the cover member 300 to the container 10 in that the support assembly 310, after being previously attached and removed, can be reattached to the cover member 300 at different locations.

Illustrative embodiments of the support assembly 310 can have brackets 311 removably attached to the cover member 300 for assembly and re-attachable to the cover member 300 for storage. In such embodiments, the brackets 311 can be configured to fit over the rim 60 of the container 10 while also fitting over at least a portion of the cover member 300 when folded (e.g., an edge of one or more folds). For instance, the support assembly 310 may be a bracket configured to fit over the rim 60, be removed during disassembly, and fit over an edge of the cover member 300 when folded. Securing the support assembly 310 to a folded cover member 300 may secure the folds of the cover member 300, e.g., during storage and transfer.

Motion of the cover member 300 relative to the container 10 may be limited by the support assembly 310. With continued reference to FIGS. 5A-5C, for instance, once the support assembly 310 is secured to the rim 60, motion of the cover member 300 relative to the container 10 can be limited in the vertical direction, outward radial direction, inward radial direction, or any combination thereof. Components of the support assembly 310 can facilitate limiting the motion of the cover member 300.

Figure 6A:
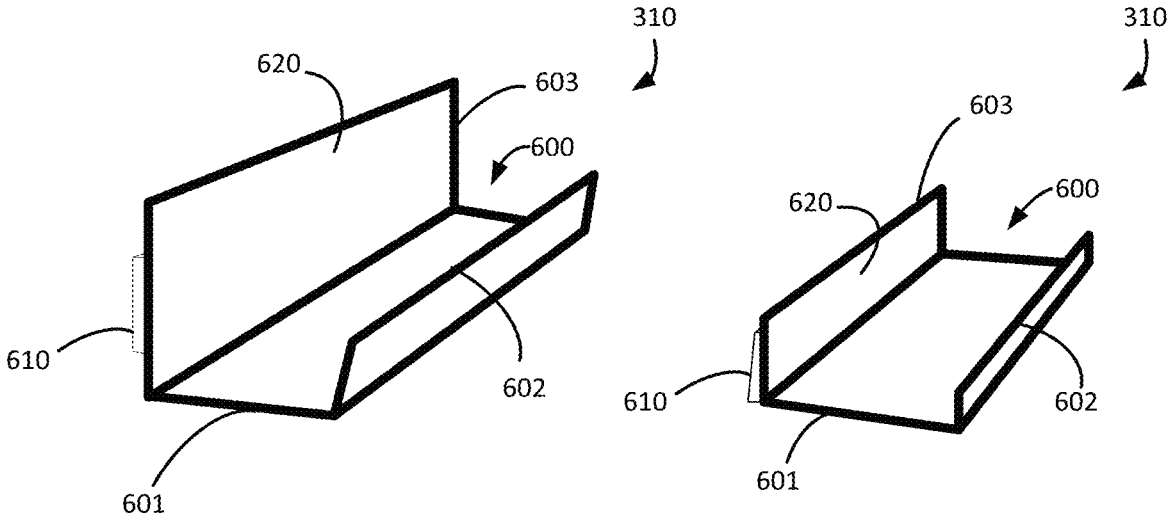
FIGS. 6A and 6B are perspective views of an embodiment of the support assembly with FIG. 6A showing the support assembly as a channel bracket with varying size of flanges thereof and FIG. 6B is view of the support assembly in FIG. 6A rotated to better show an attachment member of the support assembly.
Figure 6B:
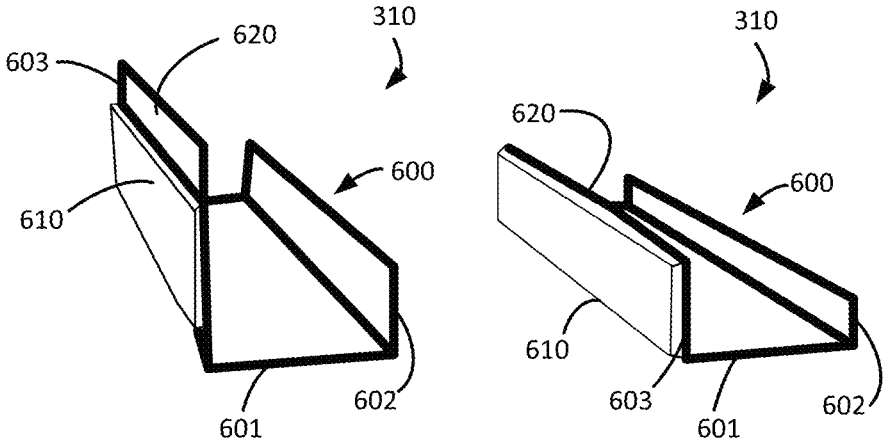

FIGS. 6A and 6B show features of an embodiment of the support assembly 310 that is a channel bracket 600 where geometry thereof may vary. FIG. 6A is a perspective view of the support assembly 310 that is the channel bracket 600 with varying size of flanges thereof. FIG. 6B is another perspective view of the support assembly 310 in FIG. 6A.

In some such embodiments, as shown in FIGS. 6A-6B, the bracket in the support assembly 310 can be a channel bracket 600. The channel bracket 600 can have a flat portion 601 and first and second lateral flanges 602, 603 downwardly extending therefrom. In some examples, at least one of the first and second lateral flanges 602, 603 can extend downwardly to form a perpendicular angle with the flat portion 601. And in other examples, at least one of the first and second lateral flanges 602, 603 can extend downwardly to form a non-perpendicular angle (e.g., an obtuse or acute angle) with the flat portion 601. When the first lateral flange 602, for example, extends to form an acute angle (e.g., 75°, 60°, 45°, 30°, etc.) with the flat portion 601, a gripping strength of the channel bracket 600 on the rim as compared to when the first lateral flange 602 extends to form a perpendicular angle with the flat portion 601 can be increased. The first lateral flange 602 can include the container connecting portion, and the second lateral flange 603 can include the support site connecting portion. The channel bracket 600 can be attached to the cover member 300 such that the flat portion 601 is parallel to an upper surface 511 of the rim 60 and attached thereto while the first and second lateral flanges 602, 603 are positioned to extend downward along an interior surface 512 or outer surface 513 of the rim 60. In instances where the bracket includes a securing device, movement of the channel bracket 600, and thereby movement of the cover member 300, along the rim 60 may be limited.

As shown in FIGS. 6A and 6B, some embodiments of the support assembly 310 may include the channel bracket 600 having a shape configured to reinforce the channel bracket 600 after installation on the container. In many embodiments, the support assembly 310 may include more than one bracket of varying dimensions (e.g., width of the flat portion 601, height of the first and second lateral flanges 602, 603, or the length of both) that is connectible to the cover member 300. For instance, in some embodiments, the first and second lateral flanges 602, 603 may extend the same distance from the flat portion 601 of the channel bracket 600 so as to have substantially the same height. In other embodiments, either the first lateral flange 602 or the second lateral flange 603 may extend to different distances from the flat portion 601 of the channel bracket 600 so as to not have substantially the same height. An attachment member 610, e.g., for attaching to the support site of the cover member 300, may be provided on one of the first lateral flange 602 or the second lateral flange 603. To reinforce and limit rotation of the channel bracket 600 around the rim, the attachment member 610 can be provided on the taller of the first and second lateral flanges 602, 603. Such an arrangement, e.g., may allow a bottom section 620 of the taller of the first and second lateral flanges 602, 603 to rest against the outer surface of the container or press against the outer surface of the container when the channel bracket 600 is rotated relative to the rim of the container in the direction of the taller of the first and second lateral flanges 602, 603.

Figure 7:
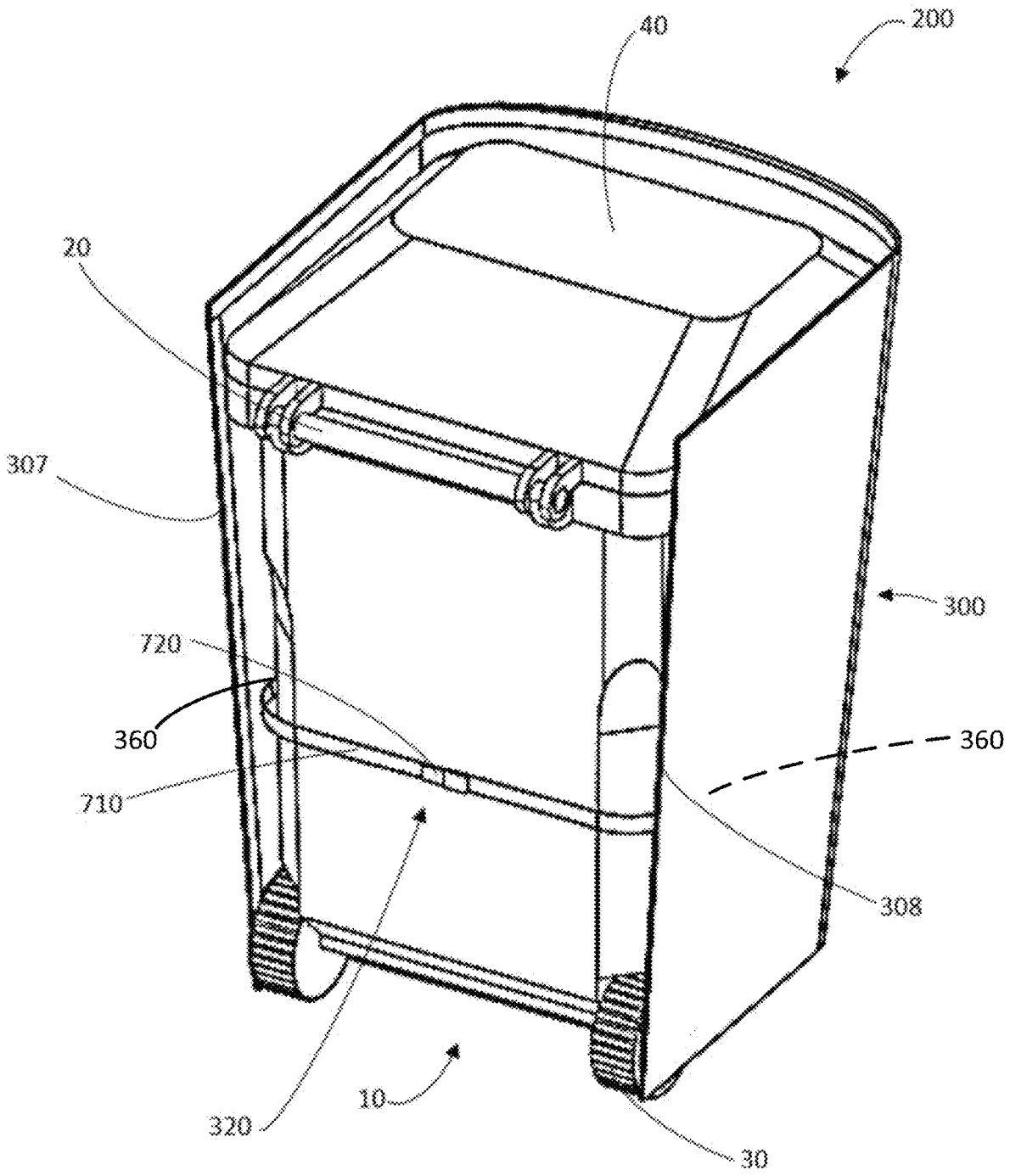
FIG. 7 is a perspective view of the container covering device of FIG. 2 shown with the retainer assembly locked to secure the container covering device to the container and to adjust and maintain a tautness of the cover member.

FIG. 7 is a perspective view of the container covering device 200 of FIG. 2. In FIG. 7, the retainer assembly 320 is locked to secure the container covering device 200 to the container 10 and to adjust and maintain a tautness of the cover member 300.

The wrapping of the cover member 300 around the container 10 can be secured via the retainer assembly 320 as shown in FIG. 7. The retainer assembly 320 can include any number of different retainers, locking mechanisms, or combinations thereof. For instance, the retainer assembly 320 may comprise one or more straps 710 fixedly attached to (e.g., sewn to or glued to) a portion of the cover member 300, e.g., the retaining site 360. In other instances, the one or more straps 710 can be removably attached to the retaining site 360. Certain embodiments of the retainer assembly 320 may have the straps 710 attached to one of the first and second lateral sides 307, 308 of the cover member 300 and a locking mechanism 720 to secure the straps 710 attached to the other one of the first and second lateral sides 307, 308 of the cover member 300. In other instances, the straps 710 may be interlocking straps 710 attached to both the first and second lateral sides 307, 308 of the cover member 300. In such instances, the locking mechanism 720 may be attached to the straps 710 themselves.

The retainer assembly 320 may limit movement of the cover member 300 relative to the container 10. The cover member 300 can be wrapped around the container 10 and secured by the retainer assembly 320 from unwrapping. For instance, the retainer assembly 320 may be configured to facilitate a taut fit of the cover member 300 over the container 10. The retainer assembly 320 can prevent movement of the cover member 300 in the radially outward direction of the container 10. The taut fit of the cover member 300 over the container 10 can prevent movement of the cover member 300 in the peripheral direction of the container 10 and in the vertical direction in relation to the container 10. As can be appreciated, the straps 710 may be adjustable to modify the fit and form of the container covering device 200 to be desirable.

In operation, the cover member 300 can surround at least a portion of the container 10 while allowing the container 10 to function normally. For instance, the container covering device 200 may still allow access to the handle 20 after installation. In addition, when the container covering device 200 is assembled on the container 10, the lid 40 of the container 10 may be allowed to open and close without interference from the cover member 300. Similarly, when the container covering device 200 is assembled on the container 10, the wheel assembly 30 may be allowed to roll, e.g., to move the trash can from one location to another.

Figure 8A:
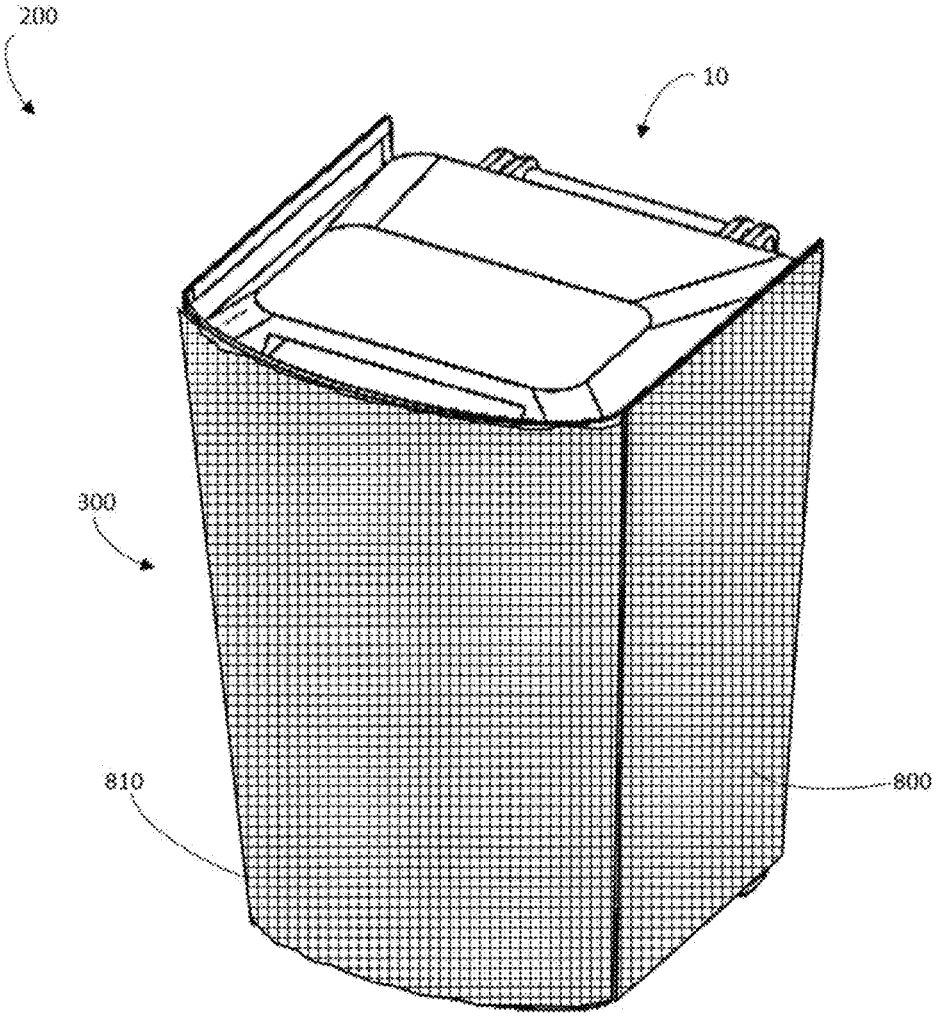
FIGS. 8A-8C are various views of an embodiment of the container covering device that includes a display with FIG. 8A being a perspective view of the container covering device installed on a refuse container, FIG. 8B being a side elevation view of the container covering device installed on a refuse container wherein the display is a cutout, and FIG. 8C being a perspective view of the container covering assembly shown in FIG. 8B.
Figure 8B:
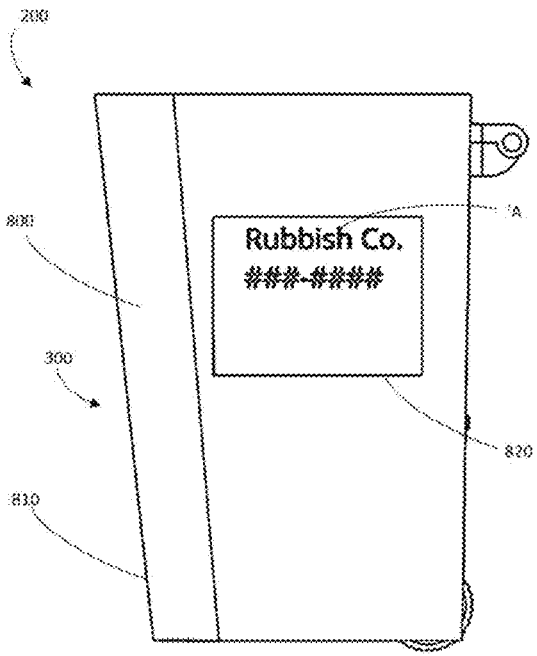
Figure 8C:
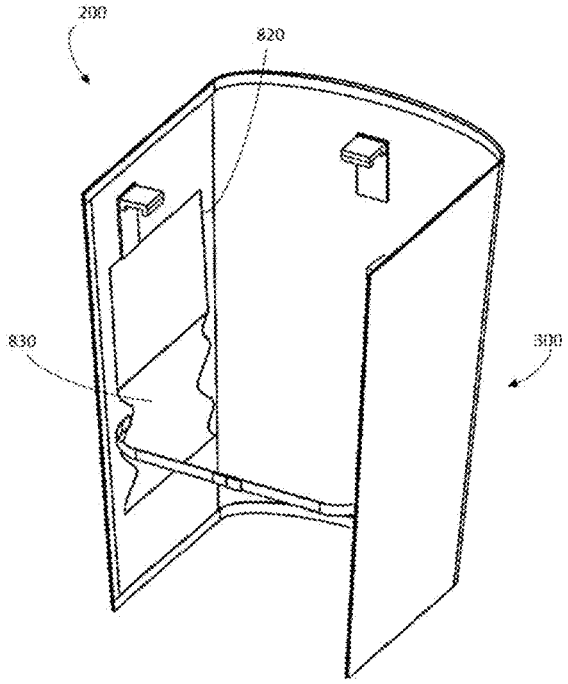

FIGS. 8A-8C show features of the container covering device 200. FIG. 8A is a perspective view of the container covering device 200 installed on a refuse container 10. In FIG. 8A, the container covering device 200 includes a display 800 on an exterior surface 810 of a cover member 300 of the container covering device 200. FIG. 8B is a side elevation view of a container covering device 200 installed on a refuse container 10. In FIG. 8B, the container covering device 200 includes a display 800 that is a cutout 820 in the cover member 300 of the container covering device 200. FIG. 8C is a perspective view of the container 10 covering assembly shown in FIG. 8B with the container 10 removed to reveal features of the cutout 820.

Covering the container 10 with the container covering device 200 may display signage on or camouflage the container 10 as shown in FIGS. 8A-8C. An exterior surface 810 of the cover member 300 can be configured such that advertising, marketing, or artwork may be displayed. For instance, as can be seen in FIG. 8A, the exterior surface 810 of the cover member 300 may include a display 800 to display the logo of a particular sports team, school, brand, or business, for example. In other instances, to blend in with actual landscape or the side of a building the display 800 on the exterior surface 810 of the cover member 300 may display a particular landscape (e.g., natural occurring substances such as rocks, logs, foliage, flowers, and/or grass) or building materials (e.g., bricks, stone, wood, siding, or fencing). The display 800 may be on one or more segments of the cover member 300 or an entirety of the cover member 300 itself. In some instances, the display 800 on the exterior surface 810 of the cover member 300 is removable and/or interchangeable. The display 800 or components thereof may be removable, replaceable, or interchangeable separate from the cover member 300. For example, FIGS. 8B and 8C show a display 800 that includes a cutout 820 for the markings, 'A, of the container 10, which is unaltered and original, to be seen. The cutout 820 may include a flap 830, which can be moved to cover and uncover the cutout 820, for instance, to be displayed during trash pickup days. Other cutouts may reveal other portions of the container 10 such as components designed to facilitate a service provider emptying the container 10. To stand out, the exterior surface 810 of the cover member 300 may include glow-in-the-dark portions or safety features such as a particular color scheme, reflectors, etc.

Figure 9:
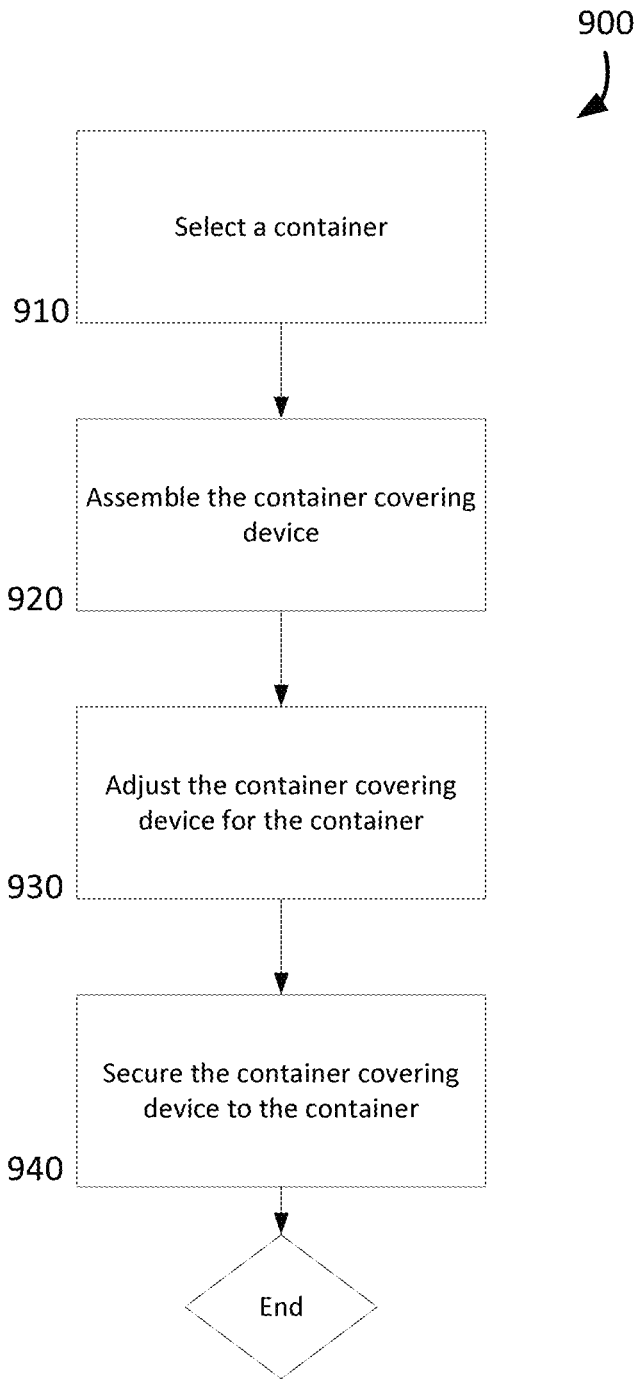
FIG. 9 is a flowchart of a method of covering a container with a container covering device.

Assembly, installation, and removal of the container covering device may be relatively simple. FIG. 9 shows a method 900 of covering a container with a container covering device. The method 900 may include providing a container covering device similar to those described elsewhere herein, including the container covering device 200. The method 900 can include selecting a container to be covered at step 910. The container selected can be similar to those discussed elsewhere herein, including the container 10. The method 900 can include assembling the container covering device at step 920, adjusting the container covering device for the container at step 930, and securing the container covering device to the container at step 940. Some embodiments of the method 900 further include a step of removing the container covering device.

During assembly, the container covering device may be adjusted to accommodate the selected container. Assembling the container at step 920 can include attaching the support assembly and the retainer assembly to the cover member body. Adjusting the container covering device for the container at step 930 can include adjusting the support assembly to the proper size for the selected container. For example, the brackets in the support assembly can be positioned at the support site in the cover member either higher (e.g., for larger and taller containers) or lower (e.g., for smaller and shorter containers). Similarly, the method 900 can include adjusting the retainer assembly to the proper size for the selected container. For example, the straps may be adjusted to be longer for larger containers or shorter for smaller containers.

During installation, the support assembly and retainer assembly may be used to secure the container covering device on the container. Securing the container covering device can include removing or opening the lid of the selected container. The method 900 can include securing the support assembly to the selected container, e.g., at the rim of the selected container, at step 940. The method 900 can include wrapping the cover member around the container. The method 900 can include securing the cover member to the container using the retainer assembly, e.g., by locking the straps with the locking mechanism, at step 940. The method 900 can include closing or installing the lid.

Some illustrative covering devices should be removed before particular events. For instance, the container covering device may be removed before being emptied, e.g., by a garbage truck, to minimize damage of the container covering device. The container covering device may be removed for storage during short and long periods of nonuse, e.g., for interchanging covers according to changes in sports seasons, holidays, etc.

Removal of the container covering device may be the reverse of installing the container covering device. Removing the container covering device can include removing or opening the lid of the selected container. The method 900 can include removing the bracket assembly from the selected container, e.g., at the rim of the selected container. The method 900 can include unwrapping the container covering device from around the container. The method 900 can include removing the retainer assembly, e.g., by unlocking the straps from the locking mechanism. The method 900 can include closing or installing the lid.

Though described in conjunction with refuse containers, the container covering device may be used by a number of different users in varying applications where it is desirable to cover the exterior of a container. For instance, residential users may use the container covering device on residential waste, recycling, and yard waste containers or any number of different storage containers. Commercial users may use the container covering device on dumpsters, delivery carts, filing cabinets, etc. The display of the container covering device may be used for advertising, camouflaging, displaying event signage, providing safety warnings, etc. Accordingly, the container covering device may be constructed in a variety of configurations of varying shapes, sizes, etc. to accommodate the wide range of users and applications.

Various examples have been described with reference to certain disclosed embodiments. The embodiments are presented for purposes of illustration and not limitation. One skilled in the art will appreciate that various changes, adaptations, and modifications can be made without departing from the scope of the invention.

What is claimed is:

1. A covering device for a refuse container, the refuse container having a container body which includes a container bottom and a container outer wall extending upwardly from the container bottom, and an opening opposite to the container bottom, the opening having a rim surrounding the opening, the refuse container having a lid located over the opening which can be rotated to cover and uncover the opening in the container body, the covering device comprising:

a cover member having a top edge, a bottom edge, a first lateral side, and a second lateral side, the cover member made of a flexible material having an interior surface and an exterior surface;

at least two support assemblies located at different locations on the interior surface of the cover member, the at least two support assemblies each having a bracket that removably fits on the rim of the container body to suspend the cover member from the rim of the container body when the cover member is attached to the container body; and a retainer assembly located on an interior surface of the cover member, the retainer assembly having a pair of straps each having one end coupled to different retainer site locations on the interior surface of the cover member and an opposite end coupled to a fastening device wherein the ends coupled to the fastening device allow the ends of each strap coupled to the fastening device to be coupled to each other when the cover member is attached to the container body so as to secure the cover member around a portion of the outer wall of the container body, wherein the refuse container having the cover member attached to the container body by the at least two support assemblies and the retainer assembly is concealed from a point of view while allowing a user to dispose of refuse in the refuse container and allowing a refuse disposal company to remove refuse contained in the refuse container without removal of the cover member, wherein the bottom edge of the cover member provides a clearance space between the bottom edge of the cover member and the container bottom when the cover member is placed on the container body.

2. The covering device of claim 1, wherein the at least two support assemblies are removably attached to a first and second support site respectively positioned on the interior surface of the cover member.

3. The covering device of claim 2, wherein the support sites extending along a height of the cover member and each bracket of the at least two support assemblies has a support site connecting portion configured to removably attach to any position along the length of the support site connection so that the attachment of the cover member can be adjusted for the size of the container body.

4. The covering device of claim 3, wherein the bracket of the at least two support assemblies comprises a channel having a flat portion and first and second lateral flanges downwardly extending from the flat portion, wherein the first lateral flange comprises a container connecting portion, and wherein the second lateral flange comprises the support site connecting portion.

5. The covering device of claim 3, wherein the support site is positioned at an upper portion of the cover member and the retainer assembly is positioned at a middle portion of the cover member.

6. The covering device of claim 3 wherein each bracket extends a distance past the rim on the outer wall side of the container body so that there is a clearance between the outer wall of the container body and the interior surface of the cover member.

7. The covering device of claim 1, wherein the cover member body further comprises at least one rib extending along a width of the cover member, the at least one rib being configured to reinforce a shape of the cover member.

8. The covering device of claim 7, wherein the at least one rib is positioned in the upper portion of the cover member.

9. The covering device of claim 8, wherein the top edge of the cover member extends upward from the rib.

10. The covering device of claim 1, wherein the cover member is wrapped around at least a majority of the outer wall of the container body.

11. The covering device of claim 1, wherein the retainer assembly to adjust the tautness of the cover member around the outer wall of the container body are adjustable.

12. The covering device of claim 11, wherein locations of the retaining site are positioned at a middle portion of the interior of the cover member adjacent to the first lateral side and the second lateral side.

13. The covering device of claim 1 wherein the exterior surface of the cover member includes a design.

14. The covering device of claim 13 further comprising a flap disposed on an interior surface of the cover member which can cover the cutout in the cover member.

15. The covering device of claim 1 further comprising a cutout in the cover member to display a portion of the outer wall of the container body when the cover member is disposed thereon.

16. The covering device of claim 15 wherein the cutout overlies information located on the outer wall of the container body so that information is displayed through the cutout.

17. The covering device of claim 1, wherein the container further comprises a wheel assembly, the wheel assembly having wheels and being positioned near the container bottom, the wheel assembly being configured to facilitate transporting the container body; and the covering device can be adjusted such that the wheels in the wheel assembly may roll the container body without interference from the cover member.

18. A method of covering a refuse container with a covering system, the method comprising:

selecting a refuse container to be covered, the refuse container having a container bottom and a container outer wall upwardly extending upwardly from the container bottom, the container outer wall defining an opening opposite the container bottom, the opening having a rim surrounding the opening, the refuse container having a lid located over the opening which can be rotated to cover and uncover the opening in the container body;

assembling a covering device comprising:

a cover member having a top edge, a bottom edge, a first lateral side, and a second lateral side, the cover member made of a flexible material having an interior surface and an exterior surface;

at least two support assemblies located at different locations on the interior surface of the cover member, the at least two support assemblies each having a bracket that removably fits on the rim of the container body to suspend the cover member from the rim of the container body when the cover member is attached to the container body; and a retainer assembly located on an interior surface of the cover member, the retainer assembly having a pair of straps each having one end coupled to different retainer site locations on the interior surface of the cover member and an opposite end coupled to a fastening device, wherein the ends coupled to the fastening device allows the ends of each strap coupled to the fastening device to be coupled to each other when the cover member is attached to the container body so as to secure the cover member around a portion of the outer wall of the container body, wherein the refuse container having the cover member attached to the container body by the at least two support assemblies and the retainer assembly is concealed from a point of view while allowing a user to dispose of refuse in the refuse container and allowing a refuse disposal company to remove refuse contained in the refuse container without removal of the cover member; and securing the covering device to the container body by placing the at least two support assemblies on the rim of the container body and securing the retaining assembly around the outer wall of the container body, wherein the bottom edge of the cover member provides a clearance space between the bottom edge of the cover member and the container bottom when the cover member is placed on the container body.

19. The method of claim 18, wherein the container further comprises a wheel assembly, the wheel assembly having wheels and being positioned near the container bottom, the wheel assembly being configured to facilitate transporting the container body; and further comprising the step of adjusting the covering device such that the wheels in the wheel assembly may roll the container body without interference from the cover member.

20. The method of claim 18, wherein securing the covering device to the container body includes adjusting the tautness of the cover member such that the cover member is uniformly draped along the container outer wall.

* * * * *